US006120005A

United States Patent [19]

Wright

[11] Patent Number: 6,120,005

[45] Date of Patent: Sep. 19, 2000

[54] DUAL COIL FUEL INJECTOR HAVING SMART ELECTRONIC SWITCH

[75] Inventor: Danny O. Wright, Cobb's Creek, Va.

[73] Assignee: Siemens Automotive Corporation, Auburn Hills, Mich.

[21] Appl. No.: 09/158,637

[22] Filed: Sep. 22, 1998

[51] Int. Cl.[7] ..... H01H 47/00

[52] U.S. Cl. ..... 251/129.1; 251/129.09

[58] Field of Search ..... 251/129.09, 129.1; 361/154–156

[56] References Cited

U.S. PATENT DOCUMENTS

| | | | |
|---|---|---|---|
| 4,338,651 | 7/1982 | Henrich | 361/154 |
| 4,355,619 | 10/1982 | Wilkinson | 123/490 |
| 5,363,270 | 11/1994 | Wahba | 361/155 |
| 5,490,534 | 2/1996 | Van Rens | 137/1 |
| 5,592,356 | 1/1997 | Ryl et al. | 361/154 |
| 5,934,258 | 8/1999 | Watanabe | 123/490 |

*Primary Examiner*—J. Casimer Jacyna

[57] ABSTRACT

A fuel injector apparatus includes an electromagnetic fuel injector having a housing and a magnetic circuit in the housing. The magnetic circuit includes a first coil having a certain resistance to generate a peak current and a second coil having a resistance greater than the certain resistance to generate a hold current. Circuit structure is disposed in the housing and is electrically coupled with the coils to selectively excite the coils. The circuit structure includes switch structure to transition the peak current to the hold current based on a preset threshold. In a preferred embodiment of the invention, the switch structure includes an RC circuit and a comparator which sets a threshold voltage. A time constant of the RC circuit is provided to be an analog model of an inductance and resistance time constant of the fuel injector such that when a voltage of a capacitor of the RC circuit exceeds the threshold voltage, the peak current is transitioned to the hold current.

22 Claims, 2 Drawing Sheets

DUAL COIL FUEL INJECTOR HAVING SMART ELECTRONIC SWITCH

BACKGROUND OF THE INVENTION

This invention relates to fuel injectors for internal combustion engines and more particularly to fuel injectors having a dual coil arrangement with one coil, defining a peak coil, having a resistance to generate peak current and the other coil, defining a hold coil, having a resistance higher than that of the peak coil to generate a hold current, and a switch structure to select when to excite the peak coil and/or the hold coil.

DESCRIPTION OF RELATED ART

At the onset of electronic fuel injection in the late 1960's and early 1970's, the standard driver circuit characteristic was a high current (called peak) to enable quick opening time response of the fuel injector followed by a low current (called hold) to just keep the injector open, thereby minimizing power dissipation in the injector and facilitating a quick closing time response.

As fuel injection technology matured into the 1980's, systems were starting to employ independent and sequential firing of each multi-point fuel injector to achieve emissions and drivability targets. Peak and hold drivers began falling out of favor due to the high cost per injector, high power (heat generation) within the Electronic Control Unit (ECU) and large amount of PC board area for implementation. Thus, it is the inventor's understanding that the use of simple saturated switch type injector drivers and high resistance coil windings (typically 12–16 ohms) on the injectors is most common. Shortcomings of the mechanical performance of the systems were compensated for by the increased processing capability of the microprocessor in the ECU. Typical algorithms included decel cutoff (to alleviate the need for fast opening of the injector) and battery voltage compensation (to keep flow more constant in the wake of injector closing time variations).

The combination of increased tightening of emission standards and the market appeal for "performance" vehicles has once again created opportunities that require the peak and hold type driver performance. In that regard, dual coil solenoid fuel injectors have been developed which use transistors to define a timing circuit to deenergize the peak coil after a predetermined time. However, since heat generated inside the solenoid can be destructive to the timing circuit, the timing circuit components are typically housed in a separate housing remote from the solenoid housing. Thus, the timing circuit consumes valuable space inside the vehicle's engine compartment.

There is a need to provide a dual coil fuel injector having a circuitry to transition peak current to hold current such that the circuitry is integral with the fuel injector thereby providing an economical and space-saving package. There is also a need to be able to use a low-cost, standard electronic control unit having saturated switch drivers with performance injectors which require peak and hold drivers and to mix-and-match as the applications require.

SUMMARY OF THE INVENTION

An object of the present invention is to fulfill the need referred to above. In accordance with the principles of the present invention, this objective is obtained by providing a fuel injector apparatus including an electromagnetic fuel injector having a housing and a magnetic circuit in the housing. The magnetic circuit includes a first coil having a certain resistance to generate a peak current and a second coil having a resistance greater than the certain resistance to generate a hold current. Circuit structure is disposed in the housing and is electrically coupled with the coils to selectively excite the coils. The circuit structure includes switch structure to transition the peak current to the hold current based on a preset threshold.

In a preferred embodiment of the invention, the switch structure includes an RC circuit and a comparator which sets a threshold voltage. A time constant of the RC circuit is provided to be an analog model of an inductance and resistance time constant of the fuel injector such that when a voltage of a capacitor of the RC circuit exceeds the threshold voltage, the peak current is transitioned to the hold current. To create the analog model, RC, the time constant of the RC circuit is set to equal L/R, the time constant of the fuel injector.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE PRESENTLY PREFERRED EXEMPLARY EMBODIMENTS

Figure 1:
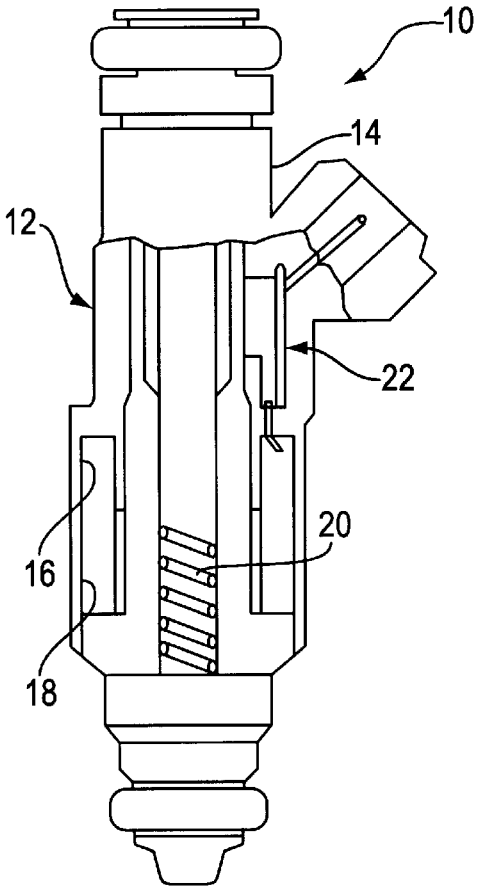
FIG. 1 is partially cut-away schematic illustration of a fuel injector apparatus provided in accordance with the principles of the present invention.
Figure 2:
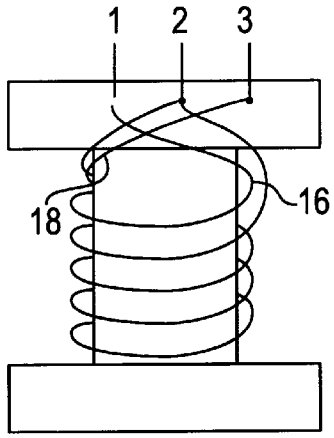
FIG. 2 schematic illustration of a dual coil winding arrangement of a fuel injector apparatus provided in accordance with the invention.

Referring to FIG. 1, a fuel injector apparatus is shown, generally indicated at 10, provided in accordance with the principles of the present invention. The fuel injector apparatus 10 comprises an electromagnetic fuel injector, generally indicated at 12, having a housing 14. A magnetic circuit is disposed in the housing 14. The magnetic circuit comprises a first or peak coil 16 having a certain resistance to generate a peak current and a second or hold coil 18 having a resistance greater than the resistance of the peak coil 16 to generate a hold current. The coils 16 and 18 are best shown in FIG. 2, which schematically illustrates a preferred winding of the coils. As shown in FIG. 2, the wind from connections 1–2 defines coil 16, and the wind from connections 2 to 3 defines coil 18. In the illustrated embodiment, the peak coil 16 consists of 130 turns #28 awg copper wire (1.2 ohms resistance) and the hold coil 18 consists of 338 turns of #34 awg copper wire (10.8 ohms resistance) for a total injector resistance of 12 ohms. It can be appreciated that many different coil windings could be employed to form the dual coil arrangement of the fuel injector 12. Further, the wire used for the coils need not be limited to copper, but may be composed of any suitable material such as, for example, brass. Further, the number of turns of the wires and the gauge of the wires may be any desired number or gauge to provide the desired injector performance. The preferred configuration for minimizing temperature rise of the apparatus 10 defines the inner windings as the hold coil 18 and the outer windings as the peak coil 16. This permits greater heat exchange of the coils with the injection fluid.

In the illustrated embodiment, the coils 16 and 18 are wound in an overlapping arrangement. It can be appreciated that the coils may be arranged end to end instead of in the overlapping arrangement.

The fuel injector 12 is thus of the conventional solenoid type having a peak or pull-in coil and a hold coil. When the solenoid is energized, a valve spring 20 is overpowered and an injector valve (not shown) moves from a closed position to an opened position. When the power to the solenoid is cutoff, the spring 20 returns the injector valve to the closed position preventing the flow of fuel to the intake manifold of the vehicle. In the conventional manner, the dual coil arrangement allows the use of a first low resistance peak coil for fast pull-in and a high resistance hold coil for low current draw during the period of fuel metering while the solenoid is held open.

With reference to FIG. 1, the overall length of the top-feed fuel injector apparatus is generally 75 mm, while the diameter of the fuel injector apparatus is approximately 21 mm. These dimensions are merely exemplary. Other sizes can of course be provided.

In accordance with the principles of the present invention, circuit structure, generally indicated at 22, is disposed in the housing 14 and is electrically connected to the coils 16 and 18 to selectively excite the coils. The circuit structure 22 comprises a circuit board 24, which carries switch structure, generally indicated at 26. The switch structure 26 is constructed and arranged to transition the peak current to the hold current based on a preset threshold, as will be explained more fully below.

Figure 4:
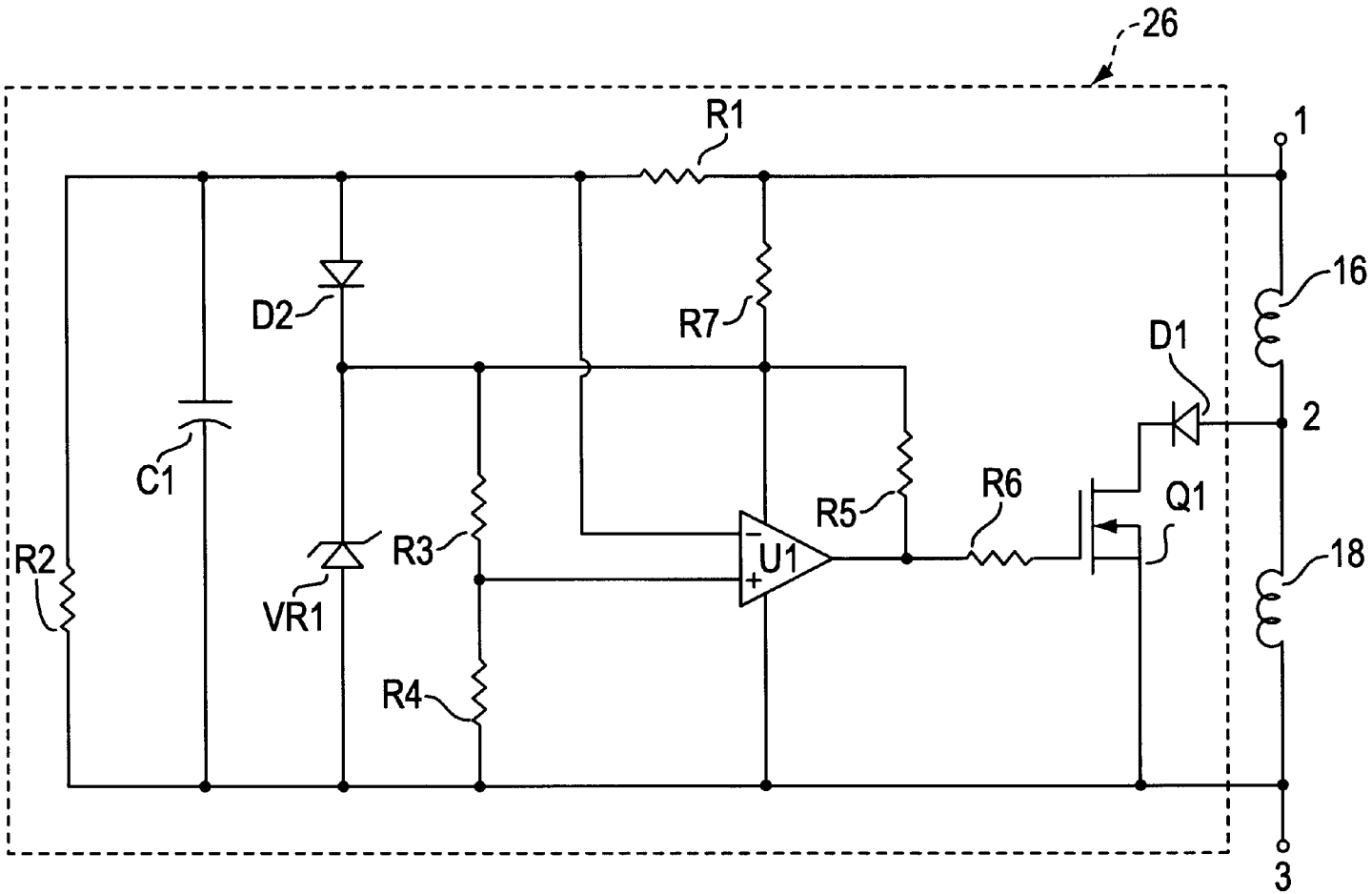
FIG. 4 is a schematic diagram of an embodiment of a switch structure of the circuit structure of FIG. 3, shown electrically connected to a pair of coils.

A preferred embodiment of the switch structure 26 is shown schematically in FIG. 4. In the illustrated embodiment, the coils the 16 in 18 are arranged in series. It can be appreciated, however, that the coils may be provided in a parallel arrangement. The switch structure 26 includes a transistor Q1 which is preferably a power Mosfet type device used to direct the flow of current initially through the peak coil 16 and then later through both the peak coil 16 and the hold coil 18 in series. Diode D1 blocks reverse current flow through the parasitic diode from the source to the drain of Q1. Comparator U1 sets a threshold for the peak to hold transition via a voltage reverence VR1 and resistors R3 and R4. The switch structure 26 provides "smart switch" which comprises a capacitor C1 and resistors R1 and R2. The RC time constant is designed to be an analog model of the fuel injector's inductance and resistance L/R time constant. That is, voltage builds on C1 as an exponential generally identical to the current build in the fuel injector as an exponential.

The analog model is based on the following equations:

$$V_t = V_{batt}(1-e^{-t/(RC)}) \quad \text{(Equation 1)}$$

where $V_t$ is the voltage across the capacitor C1 as a function of time, $V_{batt}$ is the voltage of the battery;

t is time; and

RC is a time constant.

$$i_t = V_{batt}/R_{injector}(1-e^{-t(RL)}) \quad \text{(Equation 2)}$$

where $i_t$ is the current of the injector as a function of time, $V_{batt}$ is the voltage of the battery;

$R_{injector}$ is the resistance of the injector;

t is time; and

L/R is the time constant of the injector.

To create the analog model, the time constant portion of Equations 1 and 2 are set to be equal, thus, RC=L/R. As a result, voltage builds on C1 as an exponential identical to the current build in the fuel injector as an exponential.

The peak coil 16 is initially energized to create the pull-in current. The capacitor voltage will eventually exceed the comparative threshold and force the transition from peak to hold in the fuel injector at precisely the desired injector peak current value under all voltage supply levels. Diode D2 provides rapid discharge of capacitor C1 at the completion of an injection pulse.

Selection of the peak current level is achieved via resistors R3 and R4. The selection of peak current level by use of resistors R3 and R4 provides a means to calibrate the fuel injector dynamic flow electronically. This unique calibration ability is the result of having independent control of opening time (via peak current) and closing time (via mechanical valve spring 20 preload).

Since Q1 conducts only during the time to peak of the fuel injector 12, its power dissipation is extremely low. Also, since the injector coil appears as a high resistance during the hold mode, its power dissipation is less than for a purely saturated switch mid-resistance (4.8 or 6.0 ohm) coil otherwise required to open a high lift, high flow fuel injector such as a CNG or a racing injector.

Figure 5:
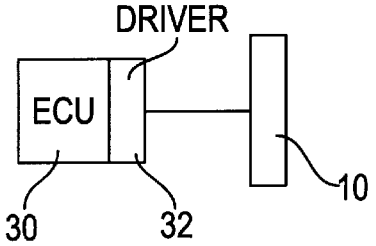
FIG. 5 is a block diagram of the fuel injector apparatus of the invention coupled with an electronic control unit.

With reference to FIG. 5, it is contemplated that the fuel injector apparatus 10 having the smart switch be used in combination with a readily available ECU 30 having a saturated switch driver 32. Thus, power savings are also realized for a vehicle ECU's saturated switch driver 32 which now only has to conduct a higher current during the peak phase of operation (readily accommodated by conventional saturated switch drivers). Further, lower average power dissipation is achieved as well. It can be appreciated that ECUs having drivers other than saturated switch type may be used to drive the fuel injector apparatus 10 of the invention.

Figure 3:
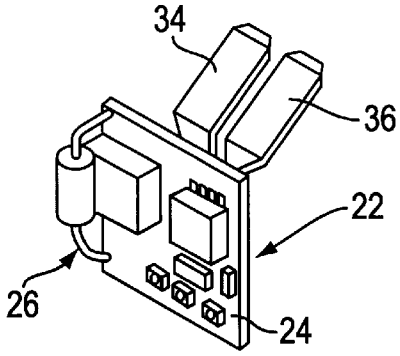
FIG. 3 is a perspective view of a circuit structure of the fuel injector apparatus of FIG. 1.

The entire switch structure is self-starting, requiring only voltage from the vehicle's battery supply and circuit continuity provided by the normal switch to "ground" action of the ECU's saturated mode driver. After the injector pulse, the switch structure 26 is inoperative until the next desired event. Thus, as shown in FIG. 3, only two connector pins 34 and 36 (corresponding to coil connections 1 and 3 of FIG. 4) are required which are constructed and arranged to mate with a conventional two-pin receiving fuel injection wiring harness (not shown).

Figure 6:
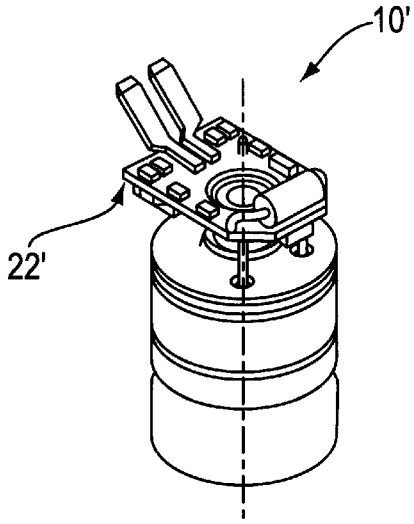
FIG. 6 is a perspective view of a bottom feed fuel injector apparatus provided in accordance with the principles of the present invention.

It can be appreciated that there are many ways to switch from the opening or peak coil to the hold coil. Instead of comparing a capacitor voltage to a threshold voltage as in the "smart switch" as explained above, the coil current may be measured and switching may occur at some preset current threshold. In addition, although the illustrated embodiment depicts a top-feed fuel injector apparatus, the invention is applicable to a bottom-feed injector as well. An example of a bottom feed fuel injector assembly is shown generally indicated at 10' in FIG. 6. The injector 10' includes circuit structure 22' which includes smart switch as discussed above.

The smart switch structure of the invention eliminates the need for a dedicated peak/hold driver box which is typically required to operate dual coil fuel injectors. Due to the simple electronics of the switch structure, economical packaging of the switch structure is possible. Thus, the switch structure may be made integral with the fuel injector. In addition, the requirement of a third electrical terminal to signal the pulsewidth to the injector has been eliminated by the switch structure of the invention. Advantageously, as mentioned above, a standard two pin connector may be employed to power the fuel injector apparatus. The injector apparatus of the invention may be employed with liquid fuels such as gasoline, methanol, liquified petroleum (LPG) as well as gaseous fuels such as compressed natural gas (CNG) or hydrogen.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel injector apparatus comprising:

an electromagnetic fuel injector having a housing and a magnetic circuit in said housing, said magnetic circuit comprising a first coil having a certain resistance to generate a peak current and a second coil having a resistance greater than said certain resistance to generate a hold current; and a circuit structure disposed in said housing, said circuit structure being electrically coupled with said coils to selectively excite said coils, said circuit structure including switch structure to transition said peak current to said hold current based on a preset threshold.

2. The fuel injector apparatus according to claim 1, wherein said switch structure comprises an RC circuit and a comparator which sets a threshold voltage, a time constant of said RC circuit being an analog model of an inductance and resistance time constant of said fuel injector such that when a voltage of a capacitor of said RC circuit exceeds the threshold voltage, said peak current is transitioned to said hold current.

3. The fuel injector apparatus according to claim 2, wherein said switch structure includes a transistor to direct current initially through said first coil and then through both said first and second coils, said first and second coils being connected electrically in series.

4. The fuel injector apparatus according to claim 2, wherein said fuel injector has a spring to close the fuel injector and said switch structure includes calibrating resistors, said calibrating resistors being selected to provide said peak current, whereby calibration of dynamic flow of the fuel injector may be accomplished electronically by selection of said calibrating resistors.

5. The fuel injector apparatus according to claim 1, wherein said circuit structure includes a circuit board and said switch structure is carried by said circuit board.

6. The fuel injector according to claim 5, wherein said circuit board has a two-pin connector constructed and arranged to mate with a two-pin receiving wiring harness to power said coils and said switch structure.

7. The fuel injector apparatus according to claim 1, in combination with an electronic control unit having a driver to operate said switch structure and thus said fuel injector.

8. The fuel injector apparatus and electronic control unit combination according to claim 7, wherein said driver is a saturated switch fuel injector driver.

9. The fuel injector apparatus according to claim 1, wherein said circuit structure includes a two-pin connector, said connector being constructed and arranged to mate with a two-pin receiving wiring harness.

10. The fuel injector apparatus according to claim 1, wherein said first and second coils are arranged in series.

11. The fuel injector apparatus according to claim 1, wherein said housing and said circuit structure are constructed and arranged so that said fuel injector apparatus may function as a bottom-feed fuel injector.

12. The fuel injector apparatus according to claim 1, wherein said housing and said circuit structure are constructed and arranged so that said fuel injector apparatus may function as a top-feed fuel injector.

13. A fuel injector apparatus comprising:

an electromagnetic fuel injector having a housing and a magnetic circuit in said housing, said magnetic circuit comprising a first coil having a certain resistance to generate a peak current and a second coil having a resistance greater than said certain resistance to generate a hold current; and a switch structure disposed in said housing and electrically coupled with said coils to selectively excite said coils, said switch structure including a RC circuit and a comparator which sets a threshold voltage, a time constant of said RC circuit being an analog model of an inductance and resistance time constant of said fuel injector such that when a voltage across a capacitor of said RC circuit exceeds the threshold voltage, said peak current is transitioned to said hold current.

14. The fuel injector apparatus according to claim 13, in combination with a driver to operate said switch and thus said fuel injector.

15. The fuel injector apparatus according to claim 14, wherein said driver is a saturated switch fuel injector driver.

16. The fuel injector apparatus according to claim 13, wherein said coils and integral switch structure are powered by a two-pin connector.

17. The fuel injector apparatus according to claim 13, wherein said first and second coils are arranged in series.

18. The fuel injector apparatus according to claim 17, wherein said switch structure includes transistor structure to direct current initially through said first coil and then through both said first and second coils.

19. The fuel injector apparatus according to claim 13, wherein said fuel injector has a spring to close the fuel injector and said switch structure includes calibrating resistors, said calibrating resistors being selected to provide said peak current, whereby calibration of dynamic flow of the fuel injector may be accomplished electronically by selection of said calibrating resistors.

20. A method of switching from a peak current to hold current in a dual coil fuel injector, the method comprising:

providing a switch structure within a fuel injector housing;

electrically coupling said switch structure with said coils to selectively excite said coils, said switch structure including a comparator and an RC circuit, a time constant of said RC circuit modeling an inductance and resistance time constant of said fuel injector;

setting a threshold voltage via said comparator; and transitioning a peak current to a hold current when a voltage across a capacitor of said RC circuit exceeds the threshold voltage.

21. The method according to claim 20, further including:

driving said switch structure with a saturated switch fuel injector driver.

22. A fuel injector comprising:

a housing having a magnetic circuit disposed within the housing, the magnetic circuit comprising a first coil having a certain resistance to generate a peak current and a second coil having a resistance greater than the certain resistance to generate a hold current;

a circuit disposed within the housing and coupled with said coils, the circuit being configured to selectively excite said coils based on a preset threshold; and an electrical connector disposed on the housing, the electrical connector consisting of first and second pins exposed to an exterior of the fuel injector, the first and second pins powering the coils and the circuit.

* * * * *